US006619539B1

(12) United States Patent
Schluger

(10) Patent No.: US 6,619,539 B1
(45) Date of Patent: Sep. 16, 2003

(54) MAIL ENVELOPE WITH MITER JOINT CORNERS

(76) Inventor: Allen Schluger, 21 W. 68th St., New York, NY (US) 10023

( * ) Notice: Subject to any disclaimer, the term of this patent is extended or adjusted under 35 U.S.C. 154(b) by 277 days.

(21) Appl. No.: 09/655,147

(22) Filed: Sep. 5, 2000

Related U.S. Application Data

(63) Continuation-in-part of application No. 09/391,899, filed on Sep. 7, 1999, and a continuation-in-part of application No. 09/088,771, filed on Jun. 2, 1998, now abandoned.

(51) Int. Cl.[7] ..... B65D 27/12
(52) U.S. Cl. ..... 229/80; 229/68.1; D19/3
(58) Field of Search ..... 229/313, 68.1, 229/80; D19/3

(56) References Cited

U.S. PATENT DOCUMENTS

| | | | | | |
|---|---|---|---|---|---|
| 2,289,118 | A | * | 7/1942 | Hatton | 229/68.1 |
| 3,015,438 | A | * | 1/1962 | Knight | 229/68.1 |
| 3,123,280 | A | * | 3/1964 | Currie | 229/68.1 |
| 5,487,826 | A | * | 1/1996 | Back et al. | 229/313 |

FOREIGN PATENT DOCUMENTS

| | | | | |
|---|---|---|---|---|
| EP | 447894 A1 | * | 3/1991 | 229/68.1 |

* cited by examiner

*Primary Examiner*—Jes F. Pascua
(74) *Attorney, Agent, or Firm*—Myron Amer PC

(57) ABSTRACT

A rectangular shaped square-corner mailing envelope constructed so that adjacent angled edges of side, bottom and top panels have a presence in adjacent parallel relation across a clearance left therebetween at each corner which simulates a miter joint, and motivates the recipient to open the envelope to inspect its contents.

1 Claim, 3 Drawing Sheets

MAIL ENVELOPE WITH MITER JOINT CORNERS

This application is a continuation-in-part of my prior application Ser. No. 09/088,771 filed Jun. 2, 1998 now abadoned for "An Envelope For Documents of Varying Bulk," and a continuation-in-part of my subsequent prior application Ser. No. 09/391,899 filed Sep. 7, 1999 for "An Envelope For Documents of Varying Bulk."

The present invention relates generally to improvements in envelopes for transmitting by mail or otherwise commercial literature or the like which typically is of varying bulk and, more particularly, to envelope improvements which address the two circumstances of significant bulk and of nominal bulk. In the former circumstance, the recipient, by the appearance of the envelope to accommodate the significant bulk is reality made aware of this happenstance. In the latter circumstance, however, nominal bulk provides no such appearance and, in practice, correspondingly provides little motivation in the recipient to open the envelope and such envelopes are commonly discarded out-of-hand as unsolicited "junk mail." In the envelope to be described, even with a one-sheet insert, i.e., of nominal bulk, there is nevertheless presented an appearance of contents with bulk which in practice contributes a motivation for the recipient to open the envelope.

As known by common experience, a typical letter-size or larger mailing envelope is embodied with a rectangular shape and, in turn, is embodied with square corners. The envelope thusly constructed manifests a flat appearance delimited by the structural features noted, which on occasion might have some variation in the perception of the recipient if the contents in the envelope has bulk, i.e., consists of a plural-sheet insert, wherein the movement of the front away from the back of the envelope to accommodate such an insert provides a width cognitive aspect to the envelope. Without actual bulk, however, there is no known envelope which "simulates" bulk and thus provides the motivation now lacking in a "flat" appearing envelope to open the envelope to inspect its contents.

Broadly, it is an object of the present invention to simulate bulk in a rectangular-square corner mailing envelope to thereby overcome the foregoing and other shortcomings of prior art mail order-soliciting envelopes.

More particularly, it is an object in retained square envelope corners to achieve a miter joint appearance and in a retained envelope rectangular shape to achieve a complementing border appearance in such shape, which cooperatively provide an overall appearance which contributes to the interest value of the envelope sent to a prospective mail order customer.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
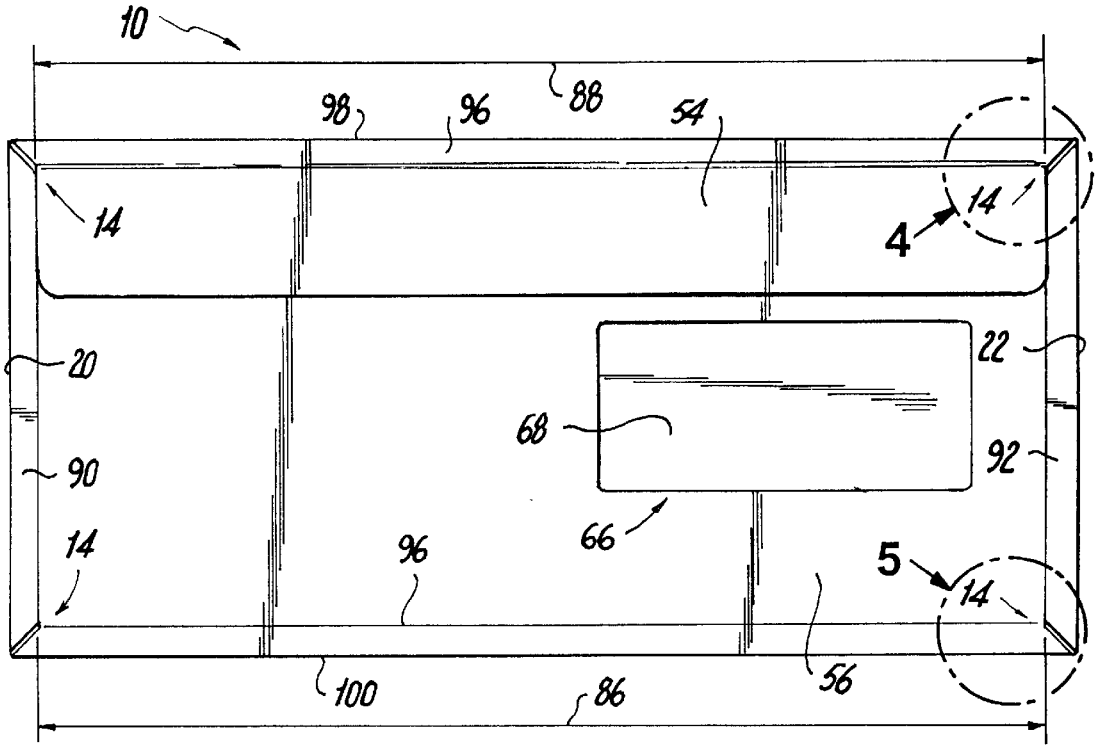
FIG. 1 is a front elevational view of a rectangular shaped sealed mail envelope according to the present invention.
Figure 4:
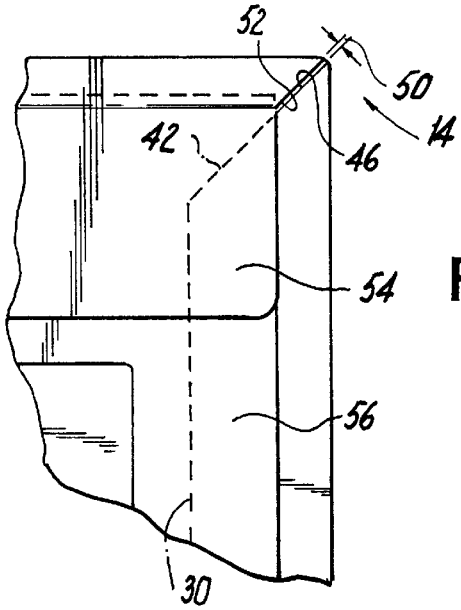
Figure 5:
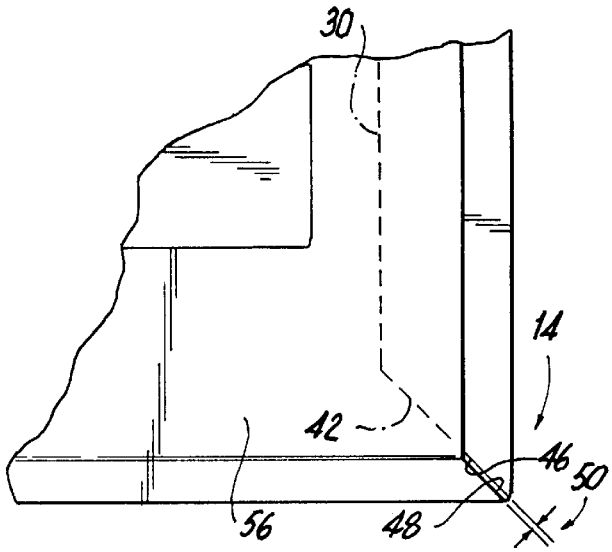
Figure 2:
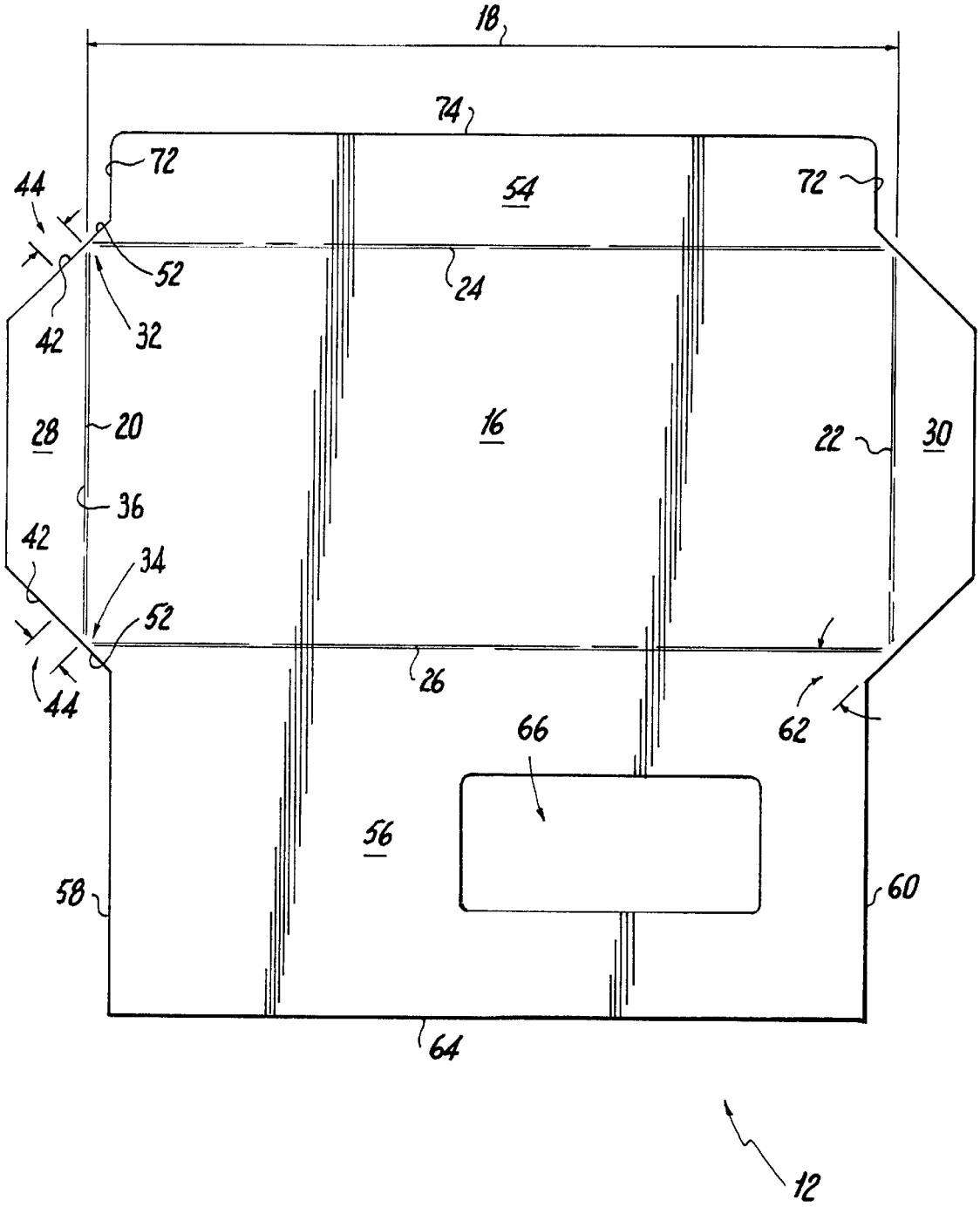
FIG. 2 is a plan view of a blank of cardboard construction material used in the construction of the envelope of FIG. 1.
Figure 3:
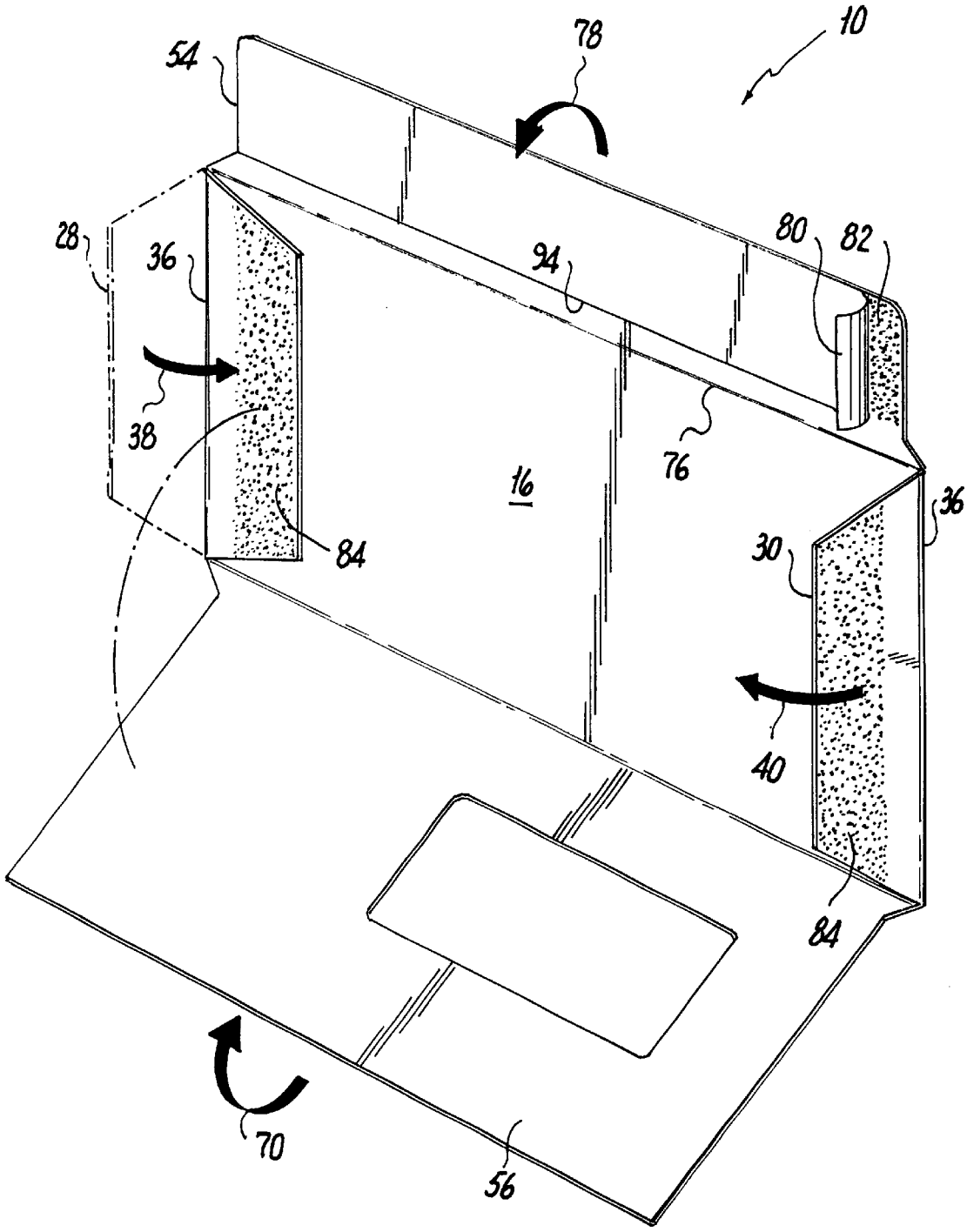

FIG. 3 is a perspective view illustrating the folding of the blank of FIG. 2 into the envelope of FIG. 1; and FIGS. 4 and 5 are partial views, on an enlarged scale, of structural details circumscribed respectively by the reference arrows 4 and 5.

Illustrated in FIG. 1 is an envelope, generally designated 10, intended primarily for mail transmittal, readily transformed into its FIG. 1 sealed condition using a blank, generally designated 12 in FIG. 2, of cardboard construction material, said envelope 10 being characterized by miter joint-appearing four corners, each individually and collectively generally designated 14 and as best understood from FIGS. 4 and 5. In practice, the miter joint corner appearances 14 contribute to a motivation to a recipient to open the envelope 10 because, it is believed, it provides the recipient with a perception that it contains contents of bulk, even though in fact it might actually only contain a single paper insert, and, as is well known in mail solicitation, the opening of a sealed mail envelope instead of it being discarded out-of-hand as unsolicited "junk mail", is a significant highly desired commercial circumstance.

Envelope 10, as noted, is constructed of a cardboard blank 12 having a rectangular rear panel 16 delimiting a selected width 18 between opposite left 20 and right 22 side edges each, in turn, having top 24 and bottom 26 edges of width 18. Integral with the rear panel 16 are left 28 and right 30 flaps, each respectively wholly joined from a top location 32 to a bottom location 34, the significance of which is that between said locations 32 and 34 there is a fold line 36 about which each flap 28, 30 is folded in directions 38 and 40 upon the rear panel 16 and presents edges 42 in a converging orientation relation to each other starting at the locations 32 and 34. As such, the initial length portions 44 of the edges 42 assume one side 46 of the noted miter joint appearance 14, the other side 48 of which is assumed across the clearance 50 by a side edge length, as at 52, of top 54 and bottom 56 panels which, like the flaps 28, 30 are integral to the rear panel 16.

More particularly, the generally designated bottom panel 56 has opposite side edges 58 and 60 extending from the angled edge lengths 44, preferably subtending an angle 62 of forty-five degrees, a lower edge 64 and a die-cut or otherwise removed window opening 66 useful for displaying an intended recipient's name and mailing address imprinted on an insert 68 advantageously aligned behind the window opening 66. Alternatively, a mailing label (not shown) can be adhesively secured to the back of the bottom panel 56 to assume a display position after the bottom panel 56 is folded in the direction 70 upon the previously infolded flaps 28, 30 upon the rear panel 16.

Completing the envelope 10 is the noted top panel 54 having opposite side edges 72 extending from the side edge lengths 52 to a top edge 74 and foldable about a bottom fold line 76 in the direction 78 upon the bottom panel 56 previously folded upon the side flaps 28 and 30. After inserting selected contents within the envelope 10 and preparatory to sealing the envelope 10, a release strip 80 is removed to expose a coat of adhesive 82 to achieve a sealing function. Similar adhesive deposits 84 on the flaps 28, 30 similarly achieve a sealing function for the envelope 10.

As best shown in FIG. 1 in conjunction with FIGS. 4 and 5, at each envelope corner there is a miter joint appearance 14 provided by the approximately 45 degree angled edges 46 and 52 in parallel relation to each other, and bounding the intentionally left nominal clearance 50 therebetween. The favorable corner appearance is enhanced by the slightly undersized widths 86 and 88 selected respectively for the top and bottom panels 54 and 56, in relation to the width 18 of the rear panel 16, presenting side borders, depicted at 90 and 92 in FIG. 1, preferably in widths starting at one quarter of an inch, but proportional to the overall size of the envelope 10, and complemented by recesses depicted at 94 and 96 spaced in parallel relation to the top and bottom external edges 98 and 100 of the top and bottom panels 54 and 56 in the sealed condition of the envelope 10.

While the envelope disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A rectangular shaped sealed mail envelope of cardboard construction material characterized by presenting a miter joint appearance at each of four corners thereof comprising a rectangular rear panel delimiting a selected width size between opposite left and right side edges and having top and bottom edges, left and right flaps respectively wholly joined from a top to a bottom location of one said left and right edge of said rear panel and having operative positions folded upon said rear panel, each said left and right flap having top and bottom inclined edges oriented in a converging relation to each other of a size measured from top and bottom starting locations on said rear panel left and right edges, for a distance spaced from each of said starting locations, a bottom panel and top panel respectively joined to said top and bottom edges of said rear panel and having operative positions folded upon and adhesively secured to an underside of said left and said right flap so as to assume interposed operative positions on top of said rear panel and beneath said left and right flaps, and said top and bottom panels each having a selected width size delimited between opposite sides of said top and bottom panels of an extent less than said width size of said rear panel and also of an extent less than distances between length portions of said left and right flap top and bottom inclined edges so as to leave exposed a beginning length portion of said inclined edges of said opposite top and bottom edges of said left and right flaps, said top and bottom panels having opposite side inclined edges oriented in a converging relation to each other and aligning in parallel relation to each said exposed beginning length portion of said inclined edges of said left and right flaps and bounding a clearance between said aligned edges in said parallel relation, whereby said aligned edges in said a parallel relation and said clearance therebetween present an appearance of a miter joint at each corner of said sealed mail envelope.

* * * * *